428-911 SR
PTH06 XR 4,079,464

United States Patent [19]

Roggin

[11] 4,079,464

[45] Mar. 21, 1978

[54] PROTECTIVE GARMENT

[76] Inventor: Sam Roggin, 23091 Rosewood, Oak Park, Mich. 48237

[21] Appl. No.: 633,368

[22] Filed: Nov. 19, 1975

[51] Int. Cl.[2] ..... F41H 1/02
[52] U.S. Cl. ..... 2/2.5
[58] Field of Search ..... 2/2.5; 428/911

[56] References Cited

U.S. PATENT DOCUMENTS

| | | | |
|---|---|---|---|
| 1,256,422 | 2/1918 | Anderson | 2/2.5 |
| 2,052,684 | 9/1936 | Wisbrod | 2/2.5 |
| 2,517,615 | 8/1950 | Webster et al. | 2/2.5 |
| 2,562,951 | 8/1951 | Rose et al. | 2/2.5 X |
| 2,640,987 | 6/1953 | Ehlers | 2/2.5 |
| 2,748,391 | 6/1956 | Lewis et al. | 2/2.5 |
| 2,773,791 | 12/1956 | MacIver | 2/2.5 X |
| 3,557,384 | 1/1971 | Barron et al. | 2/2.5 |
| 3,562,810 | 2/1971 | Davis | 2/2.5 |
| 3,783,449 | 1/1974 | Davis | 2/2.5 |
| 3,832,265 | 8/1974 | Denommee | 2/2.5 X |

*Primary Examiner*—Alfred R. Guest

*Attorney, Agent, or Firm*—Whittemore, Hulbert & Belknap

[57] ABSTRACT

A garment for protection of a person against ballistic missiles or the like, including a front and back protective panel secured together by a yoke and neck member and held in position on the upper torso of a person by straps extending between the front and back panels at the sides thereof. The panels comprising an outer cover, each having a pocket therein, a flexible ballistic pad comprising a plurality of layers of ballistic material such as nylon or Kevelar in the pocket in both panels, rigid ballistic shields constructed of a plurality of layers of ballistic material secured together by a thermosetting resin molded under heat and pressure secured over the front surface of the ballistic pad in the front panel, and a liquid-proof cover over the ballistic pad in the back panel and over the ballistic pad and shields in the front panel. Velcro closure means are provided for openings in the bottom edge of the panels through which the pads, shields and covers are positioned in the panels.

9 Claims, 14 Drawing Figures

FIG.1
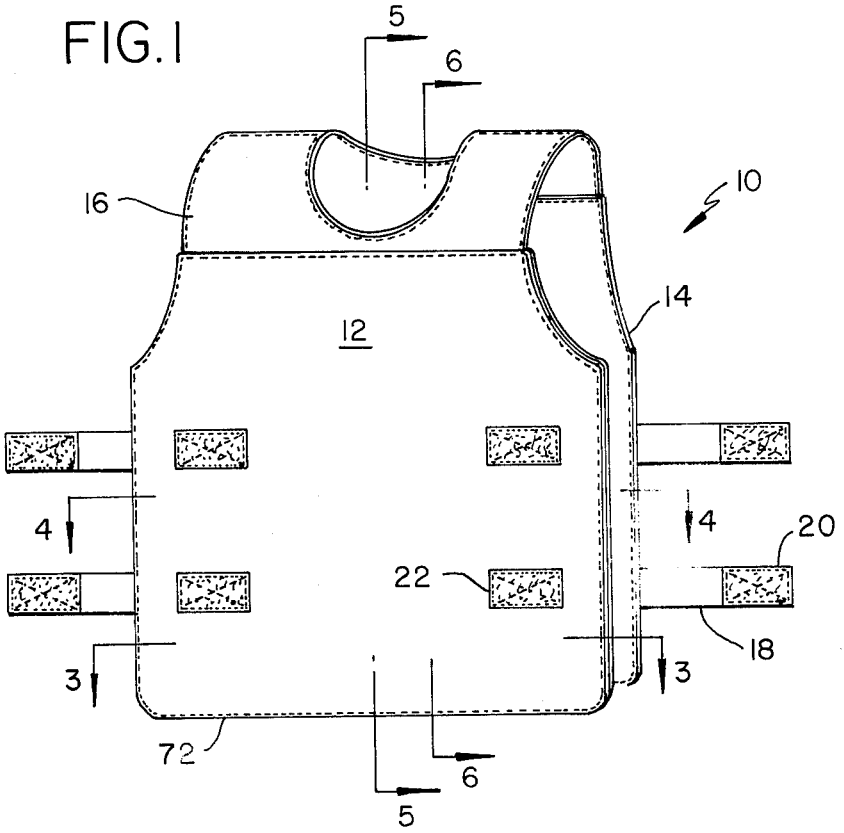
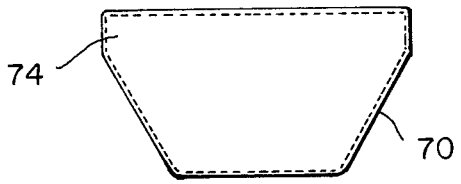
FIG.2
FIG.3
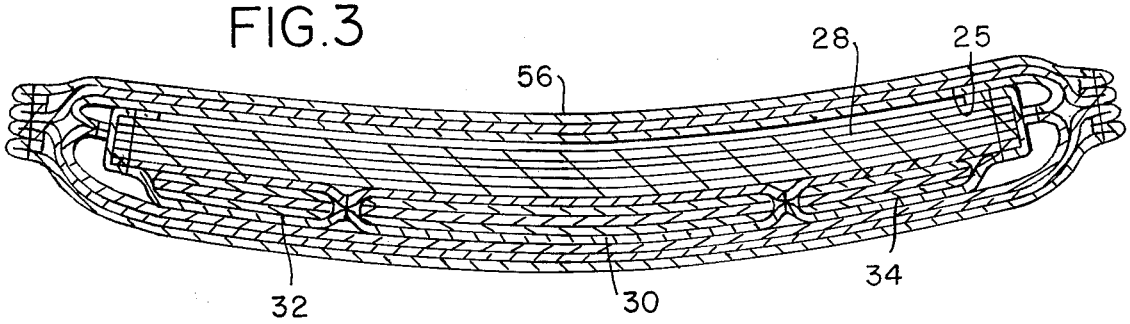
FIG.4
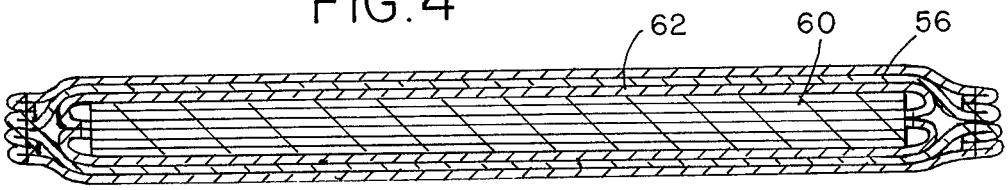

FIG. 7
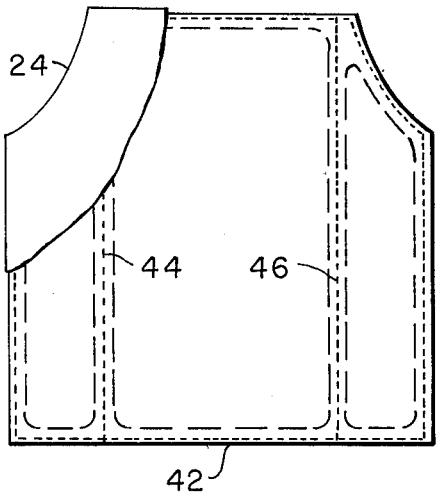
FIG. 5
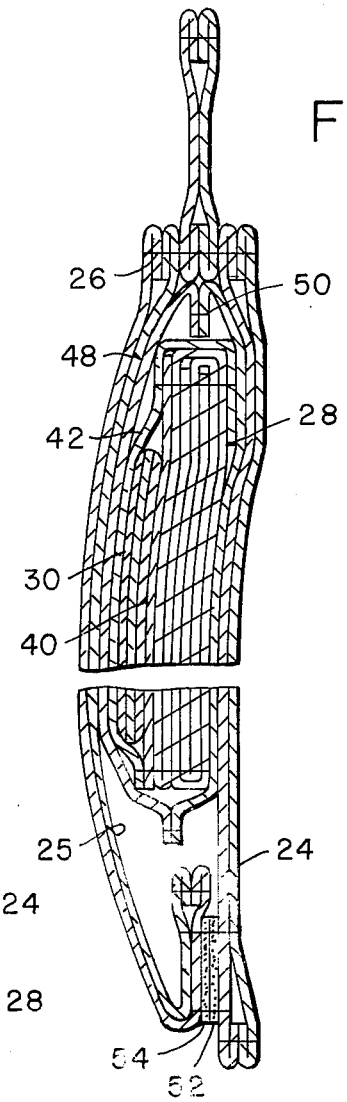
FIG. 6
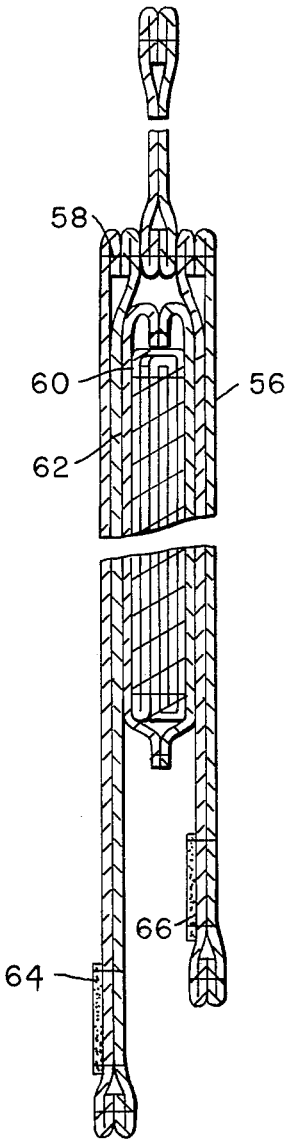
FIG. 8
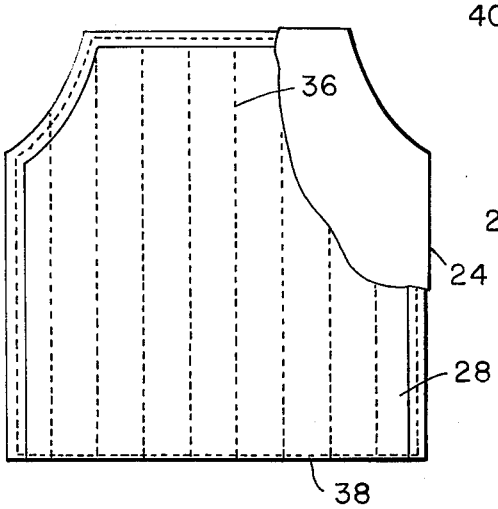
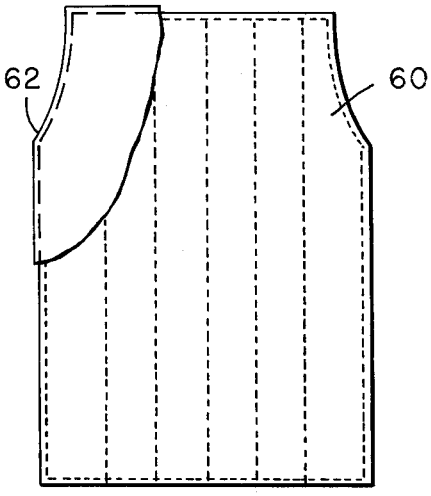
FIG. 9

PROTECTIVE GARMENT

BACKGROUND OF THE INVENTION

1. Field of the Invention

The invention relates to protective garments and refers more specifically to a garment for protecting the torso of a person from ballistic missiles or the like. 2. Description of the Prior Art In the past, metal armor, both solid and jointed so as to be flexible, has been used for personal protection against missles such as knives, spears, arrows, and the like. Such personal armor was substantially discarded with the advent of firearms, since the prior structures, when sufficiently heavy to protect against a bullet or the like, was too heavy and/or unwieldy to wear.

Recently, with the development of ballistic cloth such as ballistic nylon and Kevelar, personal garments for protection against ballistic missiles has again gained favor with law enforcement officials, soldiers, dignitaries subject to assassination, and the like. Such protective garments of the past, however, have generally suffered from inability to protect the wearer from certain ballistic missiles and/or have been particularly heavy and unwieldy.

It is, therefore, the intention of the present invention to provide a garment for personal protection against ballistic missiles which is economical, simple to construct, light in weight, sufficiently flexible to provide desired movement, and particularly efficient in stopping ballistic missiles.

SUMMARY OF THE INVENTION

In accordance with the invention, there is provided a garment including a front and back ballistic panel, a yoke and neck member securing the front and back panels together, and straps extending between the sides of the front and back panels for securing the front and back panels in position on the upper torso of a person.

The front panel includes an outer cover of four thicknesses of cloth of synthetic material sewn together around the periphery thereof and sewn together on three sides to provide a front and back of two thicknesses, each having a central pocket therein open at the bottom, both of which panels are connected to the neck and yoke member at the upper edge thereof. A ballistic pad constructed of a plurality of layers of Kevelar ballistic material sewn together by parallel lines of stitching approximately two inches apart is positioned within the central pocket in the front panel. Two sheets of ballistic nylon are sewn to the front of the ballistic pad and include pockets therebetween. A central and two side ballistic shields, which are made of a plurality of separate sheets of ballistic Kevelar and ballistic nylon impregnated with a thermosetting resin and sealed together in a predetermined form under heat and pressure are sewn in the pockets in the ballistic nylon. A liquid-proof cover is secured over the ballistic pad and ballistic shields positioned within the pocket in the front panel outer cover. Velcro closure structure is provided for closing the lower open edge of the pocket in the outer cover of the front panel.

The rear panel also includes an outer cover including a front and back consisting of two sheets of synthetic material sewn together around the periphery on three sides thereof and including an open lower edge, a ballistic pad of Kevelar material sewn parallel on approximately two inch centers placed in a liquid-proof cover and inserted within the outer cover, and Velcro closure means for securing the ballistic pad within the pocket in the back panel.

The yoke and neck member are constructed of two layers of synthetic material sewn together around the edges thereof and sewn to the top of the front panel at one edge and the top of the back panel at the opposite edge.

Optionally, a groin protector may be sewn or otherwise secured to the bottom edge of the front panel of the protective garment including an outer cover of four thicknesses of synthetic material having a pocket therein and including a Kevelar ballistic pad stitched in parallel lines on two inch centers secured within the outer cover by the stitching about the periphery of the outer cover. The groin cover may also include the liquid-proof cover over the ballistic pad between the ballistic pad and outer cover.

The ballistic shields are constructed of a plurality of layers of Kevelar ballistic material positioned between a plurality of layers of thermosetting resin impregnated fiber glass cloth positioned on both sides thereof. In manufacture of the ballistic shields, at least some of the layers of Kevelar and fiber glass are positioned with the warp strands thereof perpendicular to each other, and the Kevelar and fiber glass layers are formed into a rigid ballistic shield having a predetermined three dimensional configuration under pressure and heat.

BRIEF DESCRIPTION OF THE DRAWINGS

FIG. 1 is a perspective view of a protective garment constructed in accordance with the invention.

FIG. 2 is a perspective view of a groin protector for use with the protective garment illustrated in FIG. 1.

FIG. 3 is an enlarged, broken section view of the protective garment illustrated in FIG. 1, taken substantially on the line 3—3 in FIG. 1.

FIG. 4 is an enlarged, broken section view of the protective garment illustrated in FIG. 1, taken substantially on the line 4—4 in FIG. 1.

FIG. 5 is an enlarged, broken section view of the protective garment illustrated in FIG. 1, taken substantially on the line 5—5 in FIG. 1.

FIG. 6 is an enlarged, broken section view of the protective garment illustrated in FIG. 1, taken substantially on the line 6—6 in FIG. 1.

FIG. 7 is a front elevation view of a ballistic pad having ballistic shields secured thereto, of the protective garment of FIG. 1, showing the liquid-proof cover therefor partly broken away.

FIG. 8 is a rear view of the ballistic pad and shields of the front panel of the protective garment illustrated in FIG. 1, showing the liquid-proof cover therefor partly broken away.

FIG. 9 is a front view of the ballistic pad of the back panel of the protective garment illustrated in FIG. 1, again showing the liquid-proof cover therefor partly broken away.

FIGS. 11 and 12 are enlarged front elevation views of the side ballistic shields of the protective garment illustrated in FIG. 1.

DESCRIPTION OF THE PREFERRED EMBODIMENT

Figure 10:
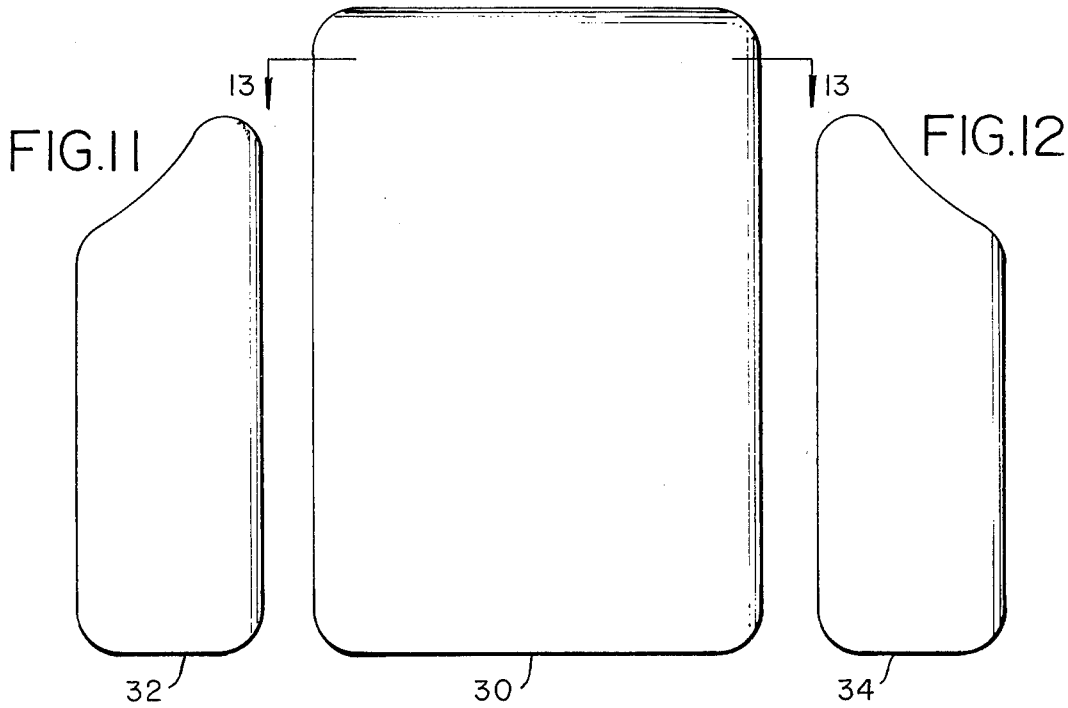
FIG. 10 is an enlarged front elevation view of the center ballistic shield of the protective garment illustrated in FIG. 1.
Figure 13:
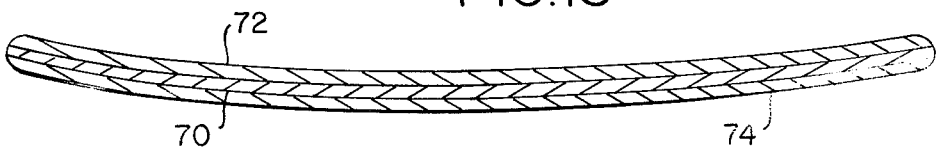
FIG. 13 is an enlarged cross section of the center ballistic shield shown in FIG. 10, taken on the line 13—13 in FIG. 10.

The protective garment 10 illustrated in FIG. 1 includes a front panel 12 and a back panel 14 connected together by a neck and yoke member 16. In use, the front and back panels 14 and 16 are secured together at the sides of the upper torso of a person wearing the garments 10 by the straps 18 having one portion 20 of Velcro connecting structure secured to the free ends thereof. The other ends of straps 18 are secured to the back panel 14. The other portion 22 of the Velcro connecting structure is secured to the front panel of the garment 10.

The front panel 12 of the garment 10, as shown best in FIGS. 3 and 5 in cross section, includes an outer cover 24 including two thicknesses of synthetic material which are sewn together at their periphery. As shown in FIG. 5, the edges of the synthetic material are turned over and secured together by stitching 26. The front edge of the neck and yoke structure is sewn between the top edge and peripheral portions of the layers of synthetic material of outer cover 24 by the stitching 26, also as shown best in FIG. 5. The bottom edge of the panels of synthetic material 24 are stitched together in pairs and thus provide a pocket 25 open at the bottom edge for receiving the ballistic pad 28 and ballistic shields 30, 32 and 34.

The ballistic pad includes a plurality of layers of ballistic material such as Kevelar or ballistic nylon formed by folding a continuous piece of the ballistic material, as shown best in FIG. 5, and ultimately sewing the continuous piece of ballistic material around the periphery thereof by stitching 38. The particular forming of the continuous piece of ballistic material into the ballistic pad, as shown in FIG. 5, is useful in preventing the pad from deforming in continued use, since no free ends are presented. Further, the missile stopping capacity of the ballistic Kevelar pad, which when formed as shown, is particularly flexible, is further enhanced by the sewing together of the layers of the pad by stitching 36 spaced in parallel lines spaced approximately 2 inches apart, as shown best in FIG. 8.

Two layers of ballistic nylon 40 and 42, one of which terminates at the edge of the ballistic pad 28 and the other of which extends over the periphery of the ballistic pad 28 on three sides thereof, as shown in FIG. 7, are also secured to the pad 28 by the stitching 38, or if preferred, by separate stitching around the periphery thereof. The nylon layers 40 and 42 provide pockets for receiving the ballistic shields 32, 30 and 34. The shields 32, 30 and 34 are secured in place relative to each other and the ballistic pad 28 by the peripheral stitching 38 and stitching 44 and 46, as shown best in FIG. 7.

The entire assembly, including the ballistic pad 28, nylon panels 42 and 40, and the ballistic shields 30, 32 and 34, are enclosed in a cover 48 of liquid-tight material secured together about its periphery by the stitching 50. The entire assembly is then placed in the pocket formed by the outer cover 24 of the front panel 12 through the open bottom edge of the front panel pocket.

A Velcro connector strip 52 is secured to the inside of the back of the outer cover panel 24 at the lower edge thereof just inside the pocket 25 therein, as shown best in FIG. 5. A cooperating Velcro connector strip 54 is secured to the outside of the front surface of the front panel on the extension 55 at the lower edge thereof. Thus, with the assembly including the ballistic pad 28, the nylon panels 40 and 42, the ballistic shields 30, 32 and 34 and the liquid-tight cover 48 within the pocket in the front panel 12 of the protective garment 10, the open bottom of the pocket is closed by folding the exterior 55 of the two front panels of the outer cover 24 into the pocket 25 at the lower edge thereof so that the Velcro connecting members face each other, as shown in FIG. 5, and pressing them together.

The back panel 14 of the protective garment 10, as shown best in FIG. 6, again includes an outer cover 56 of four separate panels secured together and to the yoke and neck member by stitching 58 about the periphery thereof. A ballistic pad 60 of Kevelar encased in a cover 62 of watertight material is again secured within the outer cover 56 by Velcro connector structure, a portion 64 of which is secured to the outside of the back of the back panel, and a portion 66 of which is secured to the inside of the front of the back panel. The Velcro connector portions are shown in their unconnected position in FIG. 6, in contrast to the connected position of similarly located Velcro portions shown in FIG. 5 on the front panel, closing the bottom of the pocket in the outer cover of the front panel.

The yoke and neck member 16 is formed substantially as shown in FIG. 1, of two layers of synthetic material forming the outer cover of the protective garment 10, which layers are sewn together about the periphery thereof as shown at the edges indicated in FIGS. 5 and 6.

The belts or straps 18 are of elastic material to secure maximum conformity of the protective garment 10 to the body of a person wearing the garment. The Velcro connector portions 20 are sewn to one end of the elastic straps 18, while the other end of the elastic straps 18 are sewn into the outer cover of the back of the protective garment 10. The Velcro connectors 22 are sewn to the front panel of the protective garment as shown best in FIG. 1.

As shown best in FIGS. 10–13, the rigid ballistic shields 30, 32 and 34 are formed of a plurality of layers such as eight layers, for example, of glue-free ballistic Kevelar 70 positioned between ten layers, for example, of woven fiber glass 72 and 74 on opposite sides thereof. The fiber glass layers are impregnated with a thermosetting resin such as a polyurethane or epxoy resin. At least some of the individual layers of the shields 30, 32 and 34 are positioned perpendicularly to the other layers of the shields to provide added strength to the composite formed on application of pressure and heat to the layers of Kevelar and fiber glass.

Figure 14:
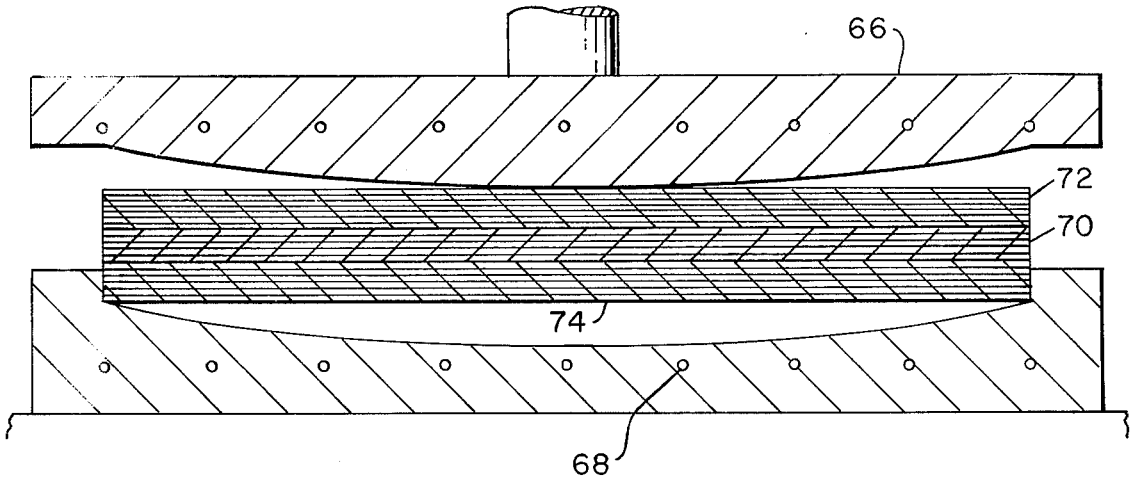
FIG. 14 is a diagrammatic representation of a heated press for forming the center ballistic shield illustrated in FIGS. 10 and 13 in accordance with the method of the invention.

The layers of Kevelar and fiber glass are formed into a desired configuration by pressure as by a press 66 shown in FIG. 14 with the application of heat as through the heat channels 68 in the press 16 as shown in FIG. 14. Such ballistic shields are particularly strong and thus efficient in stopping ballistic missiles.

If desired, a groin protection unit 70, as shown in FIG. 2, may be secured to the bottom edge 72 of the front panel of the protective garment 10 by stitching, a zipper, or other convenient attaching means. The groin protection unit 70 may again be constructed of an outer cover 74 of synthetic material stitched around its periphery including within a ballistic pad such as ballistic pad 28 and/or ballistic shields such as ballistic shields 30, 32 and 34, all enclosed in a cover of watertight material as desired.

The nylon and Kevelar ballistic material may be, for example, b 1240 denier nylon and 1000 denier Kevelar. The ballistic pads 28 and 60 may be formed of 12 layers of the 1000 denier Kevelar, more or less depending on the use of ballistic shields therewith and the missile stopping properties desired.

In use, the protective garment 10 as disclosed is normally worn beneath the clothing of an officer, soldier, or other person whose occupation places him in danger of being hit by a ballistic missile. The protective garment should then prevent ballistic missiles from entering the protected area of the torso of the person and thus prevent injury to the person and provide the person with a warning of an attack by ballistic missiles.

While one embodiment of the present invention has been considered in detail, it will be understood that other embodiments and modifications thereof are contemplated by the inventor. Thus, it will be readily understood that the invention may be expanded into a full combat suit, wherein concealment of the protective garment is unnecessary, or may be constructed as a protective article of clothing having only a front panel. Further, it will be understood that the rigid ballistic shield may or may not be used in conjunction with the flexible ballistic pad, depending on the degree of protection and/or flexibility of movement required by the person wearing the protective garment. Also, the shields may be coated as desired with porcelain or other hardened material to improve the efficiency thereof. It is the intention to include all embodiments and modifications as are defined by the appended claims within the scope of the invention.

What I claim as my invention is:

1. A garment for protection against ballistic missiles comprising at least one protective panel including an outer cover having a pocket formed therein opening downwardly, releasable means for securing the pocket in a closed position to removably retain a ballistic pad therein and to facilitate removal of the ballistic pad therefrom including a Velcro fastener, one portion of the Velcro fastener being secured to an extension of one side of the outer cover on the outside of the outer cover and one portion of the Velcro fastener being secured at the edge of the pocket at the inside of the other side of the outer cover whereby securing of the pad within the pocket is accomplished by folding the extension of the one side of the outer cover into the pocket and pressing the two portions of the Velcro fastener together, a flexible pad of ballistic material placed within the pocket, a cover of liquid-proof material positioned between the ballistic pad and outer cover, and means for securing the protective panel over a body portion.

2. Structure as set forth in claim 1, wherein the ballistic pad is constructed of a plurality of layers of a ballistic material such as Kevelar sewn together by stitching about the periphery thereof and stitched through with parallel lines of stitching at approximately two-inch spacing.

3. Structure as set forth in claim 1, and further including a rigid ballistic shield positioned over the ballistic pad and means for holding the ballistic shield in a predetermined position on the ballistic pad.

4. Structure as set forth in claim 3, and further including a separate ballistic shield adjacent to and at each side of the first mentioned ballistic shield, and wherein the means for securing the ballistic shield to the ballistic pad includes two layers of ballistic nylon forming a pocket into which the shield is positioned stitched around the periphery thereof to the periphery of the ballistic pad and stitched around the periphery of the shield.

5. Structure as set forth in claim 3, wherein the ballistic shield is comprised of a plurality of sheets of ballistic Kevelar having warp strands and a plurality of sheets of resin impregnated fiber glass having warp strands on both sides of the Kevelar sheets formed into a rigid contoured unit through heat and pressure.

6. Structure as set forth in claim 5, wherein the warp strands of at least some of the fiber glass and Kevelar sheets are positioned perpendicularly to others.

7. Structure as set forth in claim 1, wherein the protective garment includes a front panel, a rear panel, and a yoke and neck member fitting over the head and connected to the front and rear panels to hang the front and rear panels from the shoulders of a person, and the means for securing the protective garment in position includes straps on one of the front and back panels having Velcro connecting means on the ends thereof and a complementary Velcro connecting member on the other of the front and back panels.

8. Structure as set forth in claim 7, and further including a groin protector including a separate outer cover attached to the bottom of the front panel of the protective garment and including an outer covering and an inner pad adapted to extend over the lower portion of the torso of a person.

9. A garment for protection against ballistic missiles comprising at least one protective panel including an outer covering having a pocket formed therein opening downwardly, releasable means for securing the pocket in a closed position to removably retain a ballistic pad therein and to facilitate removal of the ballistic pad therefrom including a Velcro fastener, one portion of the Velcro fastener being secured to an extension of one side of the outer cover on the outside of the outer cover and one portion of the Velcro fastener being secured to the edge of the pocket at the inside of the other side of the outer cover whereby securing of the pad within the pocket is accomplished by folding the extension of the one side of the outer cover into the pocket and pressing the two portions of the Velcro fastener together, a flexible pad of ballistic material placed within the pocket, and means for securing the protective panel over a body portion.

* * * * *